US011118251B2

(12) United States Patent
Suzuki et al.

(10) Patent No.: US 11,118,251 B2
(45) Date of Patent: Sep. 14, 2021

(54) ROLLED WIRE ROD FOR SPRING STEEL

(71) Applicant: NIPPON STEEL CORPORATION, Tokyo (JP)

(72) Inventors: Takahisa Suzuki, Tokyo (JP); Yutaka Neishi, Tokyo (JP); Shuji Kozawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/620,821

(22) PCT Filed: Jun. 15, 2018

(86) PCT No.: PCT/JP2018/022965
§ 371 (c)(1),
(2) Date: Dec. 9, 2019

(87) PCT Pub. No.: WO2018/230717
PCT Pub. Date: Dec. 20, 2018

(65) Prior Publication Data

US 2020/0095663 A1 Mar. 26, 2020

(30) Foreign Application Priority Data

Jun. 15, 2017 (JP) ..... JP2017-118110

(51) Int. Cl.
*C22C 38/54* (2006.01)
*C21D 8/06* (2006.01)
(Continued)

(52) U.S. Cl.
CPC ..... *C22C 38/54* (2013.01); *C21D 8/065* (2013.01); *C22C 38/06* (2013.01); *C22C 38/42* (2013.01);
(Continued)

(58) Field of Classification Search
CPC ..... C21D 8/065; C21D 2211/002; C21D 2211/008; C22C 38/54; C22C 38/06;
(Continued)

(56) References Cited

U.S. PATENT DOCUMENTS 5,662,747 A 9/1997 Kawana et al.
2012/0247618 A1 10/2012 Hirakami et al.
(Continued)

FOREIGN PATENT DOCUMENTS

JP 6-17192 A 1/1994
JP 2004-11002 A 1/2004
(Continued)

OTHER PUBLICATIONS

JP-2004143482-A, Hagiwara Hiroshi; Hashimura Masayuki; Kakimi Takeshi; Kubota Manabu; Miyaki Takanari, English Translation obtained from J-PlatPat, 2004 (Year: 2004).*
(Continued)

*Primary Examiner* — Anthony J Zimmer
*Assistant Examiner* — Jacob James Gusewelle
(74) *Attorney, Agent, or Firm* — Birch, Stewart, Kolasch & Birch, LLP

(57) ABSTRACT

A rolled wire rod for spring steel contains, as a chemical composition, by mass %: C: 0.42% to 0.60%; Si: 0.90% to 3.00%; Mn: 0.10% to 1.50%; Cr: 0.10% to 1.50%; B: 0.0010% to 0.0060%; N: 0.0010% to 0.0070%; Mo: 0% to 1.00%; V: 0% to 1.00%; Ni: 0% to 1.00%; Cu: 0% to 0.50%; Al: 0% to 0.100%; Ti: 0% to 0.100%; Nb: 0% to 0.100%; P: limited to less than 0.020%; S: limited to less than 0.020%; and a remainder including Fe and impurities, the carbon equivalent (Ceq) is 0.75% to 1.00%, the area fraction of tempered martensite and bainite included in a microstructure is 90% or greater, the tensile strength is 1,350 MPa or less, and the reduction of area is 40% or greater.

2 Claims, 2 Drawing Sheets

(51) Int. Cl.

| | |
|---|---|
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |

(52) U.S. Cl.
CPC ..... *C22C 38/44* (2013.01); *C22C 38/46* (2013.01); *C22C 38/50* (2013.01); *C21D 2211/002* (2013.01); *C21D 2211/008* (2013.01)

(58) Field of Classification Search
CPC ..... C22C 38/42; C22C 38/44; C22C 38/46; C22C 38/50
See application file for complete search history.

(56) References Cited

U.S. PATENT DOCUMENTS

| | | | | |
|---|---|---|---|---|
| 2013/0078031 | A1* | 3/2013 | Nakamura | B23K 26/32 403/272 |
| 2015/0292052 | A1* | 10/2015 | Takeda | C22C 38/54 267/166 |
| 2018/0230566 | A1 | 8/2018 | Suzuki et al. | |
| 2018/0259022 | A1* | 9/2018 | Teramoto | C21D 9/525 |

FOREIGN PATENT DOCUMENTS

| | | | | | |
|---|---|---|---|---|---|
| JP | 2004-143482 | A | | 5/2004 | |
| JP | 2004143482 | A | * | 5/2004 | |
| JP | 3577411 | B2 | | 10/2004 | |
| JP | 2012-201983 | A | | 10/2012 | |
| JP | 103484781 | A | | 1/2014 | |
| JP | 2015-143391 | A | | 8/2015 | |
| WO | WO 2011/111872 | A1 | | 9/2011 | |
| WO | WO 2017/018457 | A1 | | 2/2017 | |
| WO | WO 2017/039012 | A1 | | 3/2017 | |
| WO | WO-2017039012 | A1 | * | 3/2017 | C22C 38/001 |

OTHER PUBLICATIONS

"Metallic materials—Tensile testing—Method of test at room temperature", JIS Z 2241 : 2011, total of 37 pages.
"Method for Charpy pendulum impact test of metallic materials", JIS Z 2242 : 2005, total of 26 pages.
International Search Report for PCT/JP2018/022965 (PCT/ISA/210) dated Aug. 28, 2018.
Written Opinion of the International Searching Authority for PCT/JP2018/022965 (PCT/ISA/237) dated Aug. 28, 2018.

* cited by examiner

ROLLED WIRE ROD FOR SPRING STEEL

TECHNICAL FIELD OF THE INVENTION

The present invention relates to a rolled wire rod for spring steel.

Priority is claimed on Japanese Patent Application No. 2017-118110 filed on Jun. 15, 2017, the content of which is incorporated herein by reference.

RELATED ART

With performance advances and weight reduction of vehicles, springs used in vehicle components have also been strengthened. For high-strengthening of the strength of the spring, high strength steels having a tensile strength of more than 1.800 MPa after a heat treatment have already been used for the manufacturing of the spring. In recent years, steels having a tensile strength of more than 2.000 MPa have also begun to be used as a spring material.

Suspension springs of vehicles are required not only to have a high strength, but also to have high toughness so as not to be damaged even by an impact load caused by unevenness of the road surface.

In recent years, a method of achieving both a strength and toughness has been proposed with a demand for further high-strengthening of the spring.

For example, Patent Document 1 discloses a method of achieving both a high strength and high toughness by optimizing amounts of alloying elements to be added, and by controlling the precipitation of carbides after quenching and tempering. However, no special mention is made except for the chemical composition of the steel and the quenching and tempering step, and there is no mention of the influence of the wire rolling step, which is a pre-step of the quenching and tempering, and the microstructure of the rolled wire rod on the material after the quenching and tempering.

Furthermore. Patent Document 2 mentions a microstructure before rolling, and discloses that drawability of a rolled wire rod is improved and hydrogen embrittlement resistance after quenching and tempering is enhanced by making a microstructure mainly composed of ferrite and pearlite, and by reducing martensite and bainite. However, there is no mention of the relationship between the mechanical properties of rolled wire rod such as a strength and toughness, and the microstructure of the rolled wire rod.

PRIOR ART DOCUMENT

Patent Document

[Patent Document 1] Japanese Patent Publication No. 3577411

[Patent Document 2] Japanese Unexamined Patent Application, First Publication No. 2015-143391

DISCLOSURE OF THE INVENTION

Problems to be Solved by the Invention

An object of the invention is to provide a rolled wire rod for spring steel suitable for a spring steel having a tensile strength of 2,000 MPa or greater and high toughness after a heat treatment such as quenching and tempering.

Means for Solving the Problem

The inventors have conducted studies, and as a result, found that by controlling not only the chemical composition, but also the microstructure of the rolled wire rod, a spring steel having high strength and high toughness can be obtained by a subsequent quenching and tempering heat treatment. The gist of the invention is the following steel.

(1) A rolled wire rod for spring steel contains, as a chemical composition, by mass %: C: 0.42% to 0.60%; Si: 0.90% to 3.00%; Mn: 0.10% to 1.50%; Cr: 0.10% to 1.50%; B: 0.0010% to 0.0060%; N: 0.0010% to 0.0070%; Mo: 0% to 1.00%; V: 0% to 1.00%; Ni: 0% to 1.00%; Cu: 0% to 0.50%; Al: 0% to 0.100%; Ti: 0% to 0.100%; Nb: 0% to 0.100%; P: limited to less than 0.020%; S: limited to less than 0.020%: and a remainder including Fe and impurities, a carbon equivalent (Ceq) specified by Formula (1) is 0.75% to 1.00%, an area fraction of tempered martensite and bainite included in a microstructure is 90% or greater, a tensile strength is 1,350 MPa or less, and a reduction of area is 40% or greater.

$$Ceq=[C\ \%]+[Si\ \%]/24+[Mn\ \%]/6+[Cr\ \%]/5+[Mo\ \%]/4+[V\ \%]/14+[Ni\ \%]/40 \quad (1)$$

(2) In the rolled wire rod for spring steel according to (1), the chemical composition may further contain, by mass %: one or more of Mo: 0.10% to 1.00% V: 0.05% to 1.00%. Ni: 0.05% to 1.00%, Cu: 0.05% to 0.50%. Al: 0.005% to 0.100%, Ti: 0.005% to 0.100%, and Nb: 0.005% to 0.100%.

Effects of the Invention

According to the rolled wire rod for spring steel according to the aspect of the invention, it is possible to obtain a spring steel having a tensile strength of 2,000 MPa or greater and high toughness by performing a heat treatment such as quenching and tempering. That is, the rolled wire rod for spring steel according to the aspect of the invention can be suitably used as a material of a high strength and high toughness spring steel. Particularly, the rolled wire rod for spring steel can be suitably used as a material of a spring steel for a suspension spring or the like.

EMBODIMENTS OF THE INVENTION

Figure 1A:
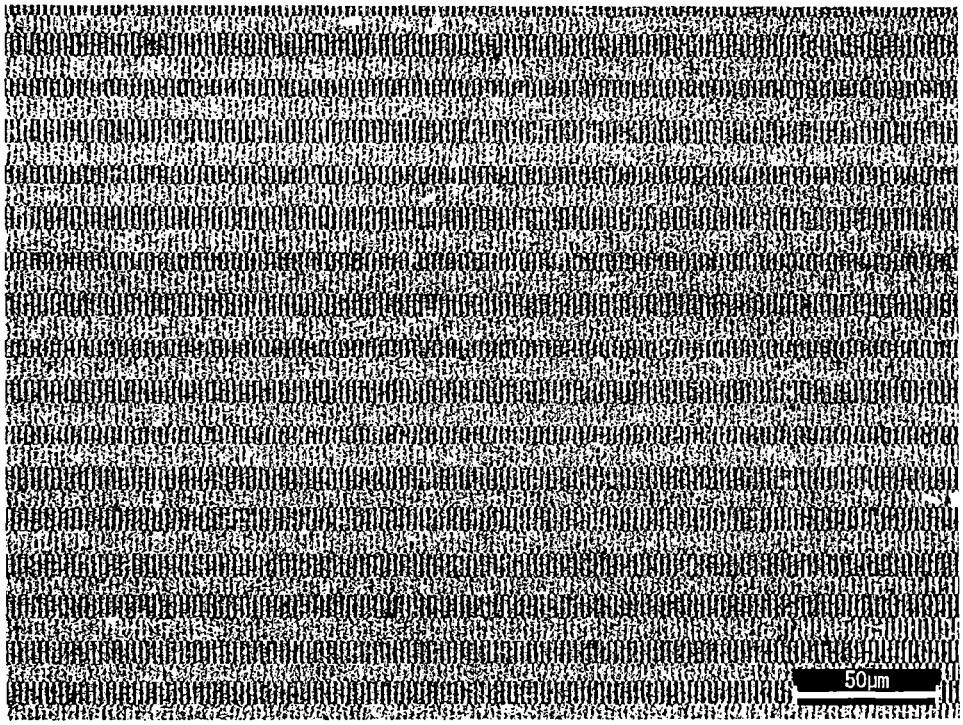
FIG. 1A is a structure photograph (magnification of 400) showing an example of the structure of a rolled wire rod for spring steel according to an embodiment.

The inventors have conducted studies on a rolled wire rod for spring steel, that is a material for obtaining a spring steel having sufficient toughness while having a high strength of a tensile strength of 2,000 MPa or greater after quenching and tempering.

As a result, the inventors have found that controlling a microstructure of a rolled wire rod for spring steel before quenching and tempering is effective for obtaining a spring steel having both a high strength and high toughness after the quenching and tempering.

In general, a spring steel (suspension spring steel) is adjusted to have high circularity and a desired wire diameter by drawing a rolled wire rod, and adjusted to have a desired strength by performing a quenching and tempering treatment to the drawn wire rod. For this reason, in general, the structure of the rolled wire rod is adjusted to soft pearlite or a dual phase structure including ferrite and pearlite having excellent drawability. In a case where soft ferrite and pearlite and hard bainite and martensite are mixed in the rolled wire rod, wire break may occur during wire drawing since the soft phase and the hard phase exhibit different deformation behaviors. Accordingly, the microstructure of the rolled wire rod has been controlled such that bainite and martensite are not mixed therein.

In recent years, it has been required to improve the tensile strength of a suspension spring steel obtained by quenching and tempering a rolled wire rod. In order to increase the tensile strength after the quenching and tempering, addition of alloying elements such as Cr, Mo, and V that improve hardenability is considered. However, in a case where the hardenability increases, bainite and martensite are likely to be formed during cooling after rolling, and thus soft ferrite and pearlite and hard bainite and martensite are likely to be mixed in the rolled wire rod. For this reason, a method has been employed in which the mixing of bainite and martensite in the structure of a rolled wire rod is suppressed by reducing a cooling rate after rolling or adjusting the alloy composition.

The invention is characterized in that in-line quenching in which a wire after hot rolling is directly put into a cooling water tank, is performed in order to form a microstructure, said microstructure including bainite and martensite as a primary phase, and, afterwards, softening annealing is performed in order to secure drawability. The martensite formed by in-line quenching turns into tempered martensite during the softening annealing. Therefore, the rolled wire rod for spring steel according to the invention has a microstructure including at least 90% of bainite and tempered martensite.

As described above, it has been thought that it is not preferable that bainite and martensite are mixed in the structure of a rolled wire rod. However, the inventors have newly found that even in a case where the microstructure after rolling includes bainite and martensite as a primary phase, by controlling a tensile strength to be equal to or less than a certain value and controlling a reduction of area to be equal to or greater than a certain value by softening annealing, it is possible to secure drawability equal to that in a case where the microstructure is composed of pearlite. The inventors have also found that the drawability decreases in a case where ferrite or pearlite of a certain amount or greater is mixed together with bainite and martensite, since a cooling rate after rolling is not sufficient or hardenability is not sufficient due to the influence of the chemical composition of the steel.

The inventors have further conducted studies, and as a result, found that when the microstructure after rolling is controlled including bainite and martensite as a primary phase and the microstructre is controlled including bainite and tempered martensite as a primary phase by annealing, carbides in the steel can be uniformly and finely dispersed as compared to conventional pearlite. In a case where the rolled wire rod is set to have such a microstructure, the carbides during a quenching and tempering treatment on the rolled wire rod for spring steel are easily solid-solubilized. As a result, it is possible to prevent undissolved carbides from remaining after the quenching while refining prior austenite grains by reducing the quenching temperature. That is, the inventors have found that in a case where the microstructure of the rolled wire rod after rolling is set to include bainite and martensite as a primary phase and to include bainite and tempered martensite as a primary phase by annealing, the toughness after quenching and tempering is also improved.

The inventors have found that by allowing the microstructure after rolling to be mainly composed of bainite and martensite, and by performing softening annealing, it is possible to enhance mechanical properties after quenching and tempering (high-strengthening and toughness enhancement) while securing drawability in a post-step wire drawing to be performed to manufacture a spring steel.

Hereinafter, a rolled wire rod for spring steel according to an embodiment of the invention based on the above knowledge (a rolled wire rod for spring steel according to this embodiment) will be described.

Reasons for restricting the chemical composition of the rolled wire rod for spring steel according to this embodiment will be described.

[C: 0.42% to 0.60%]

C is an element having a great influence on the strength of steel. The C content is set to 0.42% or greater in order to impart a sufficient strength to the steel after quenching and tempering. The C content is preferably 0.43% or greater, and more preferably 0.45% or greater.

In a case where the C content is excessive, untransformed austenite (residual austenite) increases in the steel after quenching and tempering, and thus a strength increase effect due to the C content is reduced. In addition, toughness significantly decreases. Therefore, the C content is set to 0.60% or less. The C content is preferably 0.58% or less.

[Si: 0.90% to 3.00%]

Si is an element that increases the strength of a spring steel manufactured from a rolled wire rod for spring steel. Particularly, Si suppresses softening during tempering to be performed after quenching. Furthermore, Si is an element that improves the settling resistant properties that is a resistance to the shape change of the spring during use. In order to obtain such effects, the Si content is set to 0.90% or greater in the rolled wire rod for spring steel according to this embodiment. The Si content is preferably 1.20% or greater, and more preferably 1.40% or greater.

In a case where the Si content is excessive, the steel is significantly embrittled. Therefore, the Si content is set to 3.00% or less. The Si content is preferably 2.50% or less.

[Mn: 0.10% to 1.50%]

Mn is an element that improves the hardenability of steel, and is an element necessary for obtaining bainite and martensite during direct quenching after hot rolling. In order to obtain such effects, the Mn content is set to 0.10% or greater in the rolled wire rod for spring steel according to this embodiment. The Mn content is preferably 0.30% or greater.

In a case where the Mn content is excessive, soft residual austenite increases after quenching and tempering, and thus the tensile strength decreases. In the rolled wire rod for spring steel according to this embodiment, the Mn content is set to 1.50% or less in order to suppress the formation of residual austenite. The Mn content is preferably 1.00% or less, and more preferably 0.70% or less.

[Cr: 0.10% to 1.50%]

Cr is an element necessary for improving the hardenability of steel and for obtaining bainite and martensite during direct quenching after hot rolling. In addition, Cr is an element necessary for controlling the precipitation state of carbides and for securing the strength of steel after quenching and tempering. In order to obtain such effects, the Cr content is set to 0.10% or greater in the rolled wire rod for spring steel according to this embodiment. The Cr content is preferably 0.30% or greater, and more preferably 0.50% or greater.

In a case where the Cr content is excessive, soft residual austenite increases after quenching and tempering, and thus the tensile strength decreases, and the steel is embrittled. Therefore, the Cr content is set to 1.50% or less in the rolled wire rod for spring steel according to this embodiment. The Cr content is preferably 1.00% or less.

[B: 0.0010% to 0.0060%]

B is an element necessary for improving the hardenability of steel and for obtaining bainite and martensite during direct quenching after hot rolling. In addition, B is an element that preferentially segregates to prior austenite grain boundaries that are likely to be fracture origins, suppresses the segregation of P and S to grain boundaries, and thus contributes to an increase in the grain boundary strength and an improvement in the toughness. In order to obtain these effects, the B content is set to 0.0010% or greater in the rolled wire rod for spring steel according to this embodiment. The B content is preferably 0.0020% or greater.

In a case where the B content is excessive, there is a concern that these effects may be saturated, and the toughness of steel may decrease due to $Fe_{23}(CB)_6$ or the like precipitated at grain boundaries. Therefore, the B content is set to 0.0060% or less. The B content is preferably 0.0050% or less.

[N: 0.0010% to 0.0070%]

N is an element that forms various nitrides in steel. Nitride particles that are stable even at high temperatures contribute to the refinement of prior austenite grains due to the pinning effect of austenite grain growth. The N content is set to 0.0010% or greater in the rolled wire rod for spring steel according to this embodiment. The N content is preferably 0.0020% or greater.

In a case where the N content is excessive, coarse nitrides to be fracture origins are formed, and toughness and fatigue properties thus decrease. Furthermore, in a case where the N content is excessive, N combines with B to form BN, and reduces the amount of solid solution B. In a case where the amount of solid solution B is reduced, there is a concern that the effect of improving the hardenability and the effect of improving the grain boundary strength by B may be impaired. Therefore, the N content is set to 0.0070% or less. The N content is preferably 0.0060% or less.

[P: Less Than 0.020%]

P is an element that is present in steel as an impurity element and embrittles the steel. Particularly, P segregating to prior austenite grain boundaries reduces the grain boundary strength and causes the embrittlement of the steel. Therefore, the smaller the P content is, the better it is. In order to prevent the embrittlement of the steel, the P content is limited to less than 0.020% in the rolled wire rod for spring steel according to this embodiment. The P content is preferably 0.015% or less.

[S: Less Than 0.020%]

S is an element that is present in steel as an impurity element and embrittles the steel similar to P. S can be fixed as MnS by containing Mn, but in a case where MnS coarsens, it acts as a fracture origin and degrades fracture properties of the steel. In order to suppress these adverse effects, the smaller the S content is, the more preferable it is, and the S content is limited to less than 0.020% in the rolled rod wire for spring steel according to this embodiment. The S content is preferably 0.015% or less, and more preferably 0.010% or less.

Basically, the rolled wire rod for spring steel according to this embodiment contains the above-described elements with the remainder including Fe and impurities. However, the rolled wire rod for spring steel may further contain one or more of Mo, V, Ni, Cu, Al, Ti, and Nb instead of a part of Fe. However, Mo, V, Ni, Cu, Al, Ti, and Nb are optional elements, and the chemical composition of the steel according to this embodiment may not contain these elements. Therefore, the lower limit of the content of each of Mo, V, Ni, Cu, Al, Ti, and Nb is 0%.

The impurities are components that are mixed in from raw materials such as ore or scrap, or from various environments in the manufacturing steps in the industrial manufacturing of steel, and mean components that are accepted within a range that does not adversely affect the steel.

[Mo: 0% to 1.00%]

Mo is an element effective for improving the hardenability of steel and for obtaining bainite and martensite during direct quenching after hot rolling. In addition, Mo is an element effective for controlling the precipitation state of carbides and for securing the strength of steel after quenching and tempering. In order to obtain such effects, the Mo content may be set to 0.10% or greater. In a case where the Mo content exceeds 1.00%, these effects are saturated. Mo is an expensive element, and it is not preferable that Mo is contained more than necessary. Therefore, even in a case where Mo is contained, the Mo content is set to 1.00% or less. The Mo content is preferably 0.60% or less.

[V: 0% to 1.00%]

V is an element effective for improving the hardenability of steel and for obtaining bainite and martensite during direct quenching after hot rolling. In addition, V is an element effective for controlling the precipitation state of carbides and for securing the strength of steel after quenching and tempering. In order to obtain such effects, the V content may be set to 0.05% or greater. In a case where the V content exceeds 1.00%, coarse undissoved precipitates are formed, and the steel is embrittled. Therefore, even in a case where V is contained, the upper limit of the V content is set to 1.00% or less. The upper limit of the V content is preferably 0.50% or less.

[Ni: 0% to 1.00%]

Ni is an element that improves the hardenability of steel, and also has an effect of improving the corrosion resistance of the steel. In order to obtain these effects, the Ni content may be set to 0.05% or greater, and more preferably 0.10% or greater in the rolled wire rod for spring steel according to this embodiment. In a case where the Ni content is excessive, soft residual austenite increases after quenching and tempering, and thus the tensile strength decreases. Therefore, the Ni content is set to 1.00% or less even in a case where Ni is contained. The upper limit of the Ni content is preferably 0.50% or less.

[Cu: 0% to 0.50%]

Cu is an element that improves the hardenability of steel, and also has an effect of improving the corrosion resistance of the steel. In order to obtain these effects, the Cu content may be set to 0.05% or greater, and more preferably 0.10% or greater in the rolled wire rod for spring steel according to this embodiment. In a case where the Cu content is excessive, there is a concern that the hot ductility of steel may decrease, and cracking may occur during hot rolling. Therefore, the Cu content is set to 0.50% or less even in a case where Cu is contained. The upper limit of the Cu content is preferably 0.30% or less.

[Al: 0% to 0.100%]

Al is used as a deoxidizing element, and also reacts with N in steel and forms AlN. Since AlN suppresses coarsening of the austenite grains by pinning the growth of austenite grains during a heat treatment, Al is an element effective for grain refinement. Al also has an effect of suppressing the formation of BN by fixing N, thereby improving the effects obtained by B. In order to obtain these effects, the Al content may be set to 0.005% or greater, and more preferably 0.010% or greater. In a case where the Al content is excessive, coarse AlN is formed, and thus toughness decreases. The Al content is set to 0.100% or less in the rolled wire rod for spring steel according to this embodiment. The Al content is preferably 0.050% or less, and more preferably 0.035% or less.

[Ti: 0% to 0.100%]

Ti reacts with N or C in steel and forms TiN or TiC, thereby pinning the growth of austenite grains during a heat treatment, and suppressing coarsening. Therefore, Ti is an element effective for grain refinement. Ti also has an effect of suppressing the formation of BN by fixing N, thereby improving the effects of B. In order to obtain these effects, the Ti content may be set to 0.005% or greater, and more preferably 0.010% or greater. In a case where the Ti content is excessive, coarse TiN is formed, and thus toughness decreases. Therefore, the Ti content is set to 0.100% or less even in a case where Ti is contained in the rolled wire rod for spring steel according to this embodiment. The Ti content is preferably 0.070% or less.

[Nb: 0% to 0.100%]

Nb reacts with N or C in steel and forms Nb (CN), thereby pinning the growth of austenite grains during a heat treatment, and suppressing coarsening, and is an element effective for grain refinement, Nb also has an effect of suppressing the formation of BN by fixing N, thereby improving the effects of B. In order to obtain these effects, the Nb content may be set to 0.005% or greater, and more preferably 0.010% or greater. In a case where the Nb content is excessive, coarse Nb (CN) is formed, and thus toughness decreases. The Nb content is set to 0.100% or less even in a case where Nb is contained in the rolled wire rod for spring steel according to this embodiment. The Nb content is preferably 0.050% or less.

The rolled wire rod for spring steel according to this embodiment is characterized in that bainite and martensite are obtained during direct quenching after hot rolling. Therefore, in order to secure hardenability, Ceq (carbon equivalent) that is calculated by the following Formula (1) is adjusted to 0.75% or greater. The lower limit of Ceq is preferably 0.80% or greater. In a case where Ceq is too high, problems such as quenching cracks during quenching and an increase of residual austenite are generated. In a case where Ceq is too high, there is a concern that undissolved carbides may remain in quenching and tempering of the rolled wire rod for spring steel. Therefore, the upper limit of Ceq is set to 1.00% or less. The upper limit of Ceq is preferably 0.90% or less. The mass % of the respective elements are substituted for the element symbols in Formula (1). That is, for example, in a case of [C %], the C content by mass % is substituted. In a case of steel that does not positively contain Mo, V, or Ni, 0% is substituted for [Mo %] [V %], or [Ni %].

$$Ceq=[C\ \%]+[Si\ \%]/24+[Mn\ \%]/6+[Cr\ \%]/5+[Mo\ \%]/4+[V\ \%]/4+[Ni\ \%]/40 \quad (1)$$

The microstructure of the rolled wire rod for spring steel according to this embodiment is a structure in which a total of bainite and tempered martensite is 90% or greater, and more preferably 95% or greater by area fraction. The total of bainite and tempered martensite may be 100%. There is no need to limit the each area fraction of the bainite and the tempered martensite. The remainder in the microstructure is 0% or greater and less than 10%, and more preferably 0% or greater and less than 5%. The remainder in the microstructure includes one or more of ferrite, pearlite, and residual austenite. In a case where a total area fraction of bainite and tempered martensite is less than 90% (the remainder in the microstructure is 10% or greater), ductility is reduced, a reduction of area in a tensile test is reduced, and drawability is reduced.

This microstructure is formed through rapid cooling after hot rolling and subsequent softening annealing for strength adjustment.

The rolled wire rod for spring steel according to this embodiment has a tensile strength of 1,350 MPa or less and a reduction of area of 40% or greater. In a case where the tensile strength exceeds 1,350 MPa or the reduction of area is less than 40%, breaking is likely to occur during wire drawing which is performed in the manufacturing of spring steel wire. Since the rolled wire rod after rapid cooling has a high tensile strength, it is softened and annealed such that the tensile strength is 1,350 MPa or less to obtain a strength suitable for wire drawing. By softening annealing, the tensile strength is adjusted to 1.350 MPa or less, and the reduction of area is adjusted to 40% or greater.

Regarding the microstructure of the rolled wire rod steel for spring steel, a microstructure observation test piece is collected from the rolled wire rod for spring steel and is observed. Specifically, the rolled wire rod for spring steel may be cut at a central longitudinal cross section, and etched with 3% initial (3% nitric acid-ethanol solution) after forming and polishing, a position of ¼ of the diameter inside from the surface of the rolled wire rod in the longitudinal cross section may be set as an observation position, 5-visual field observation may be performed with an optical microscope for metallic microstrucuture with magnification of 400, and the obtained area fractions may be averaged.

The observed microstructures are classified and determined as "bainite and tempered martensite", "ferrite", and "pearlite", and the area fraction of "bainite and tempered martensite" is obtained. Since it is difficult to distinguish the bainite from the tempered martensite, both may be handled together.

Figure 1B:
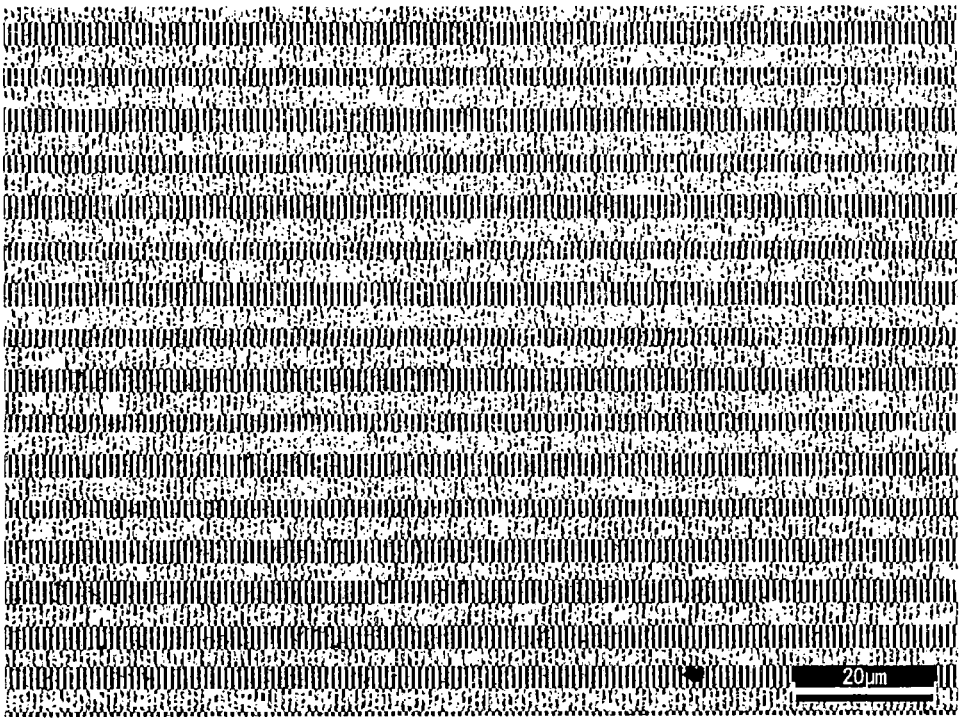
FIG. 1B is a structure photograph (magnification of 1,000) showing an example of the structure of the rolled wire rod for spring steel according to the embodiment.
Figure 2A:
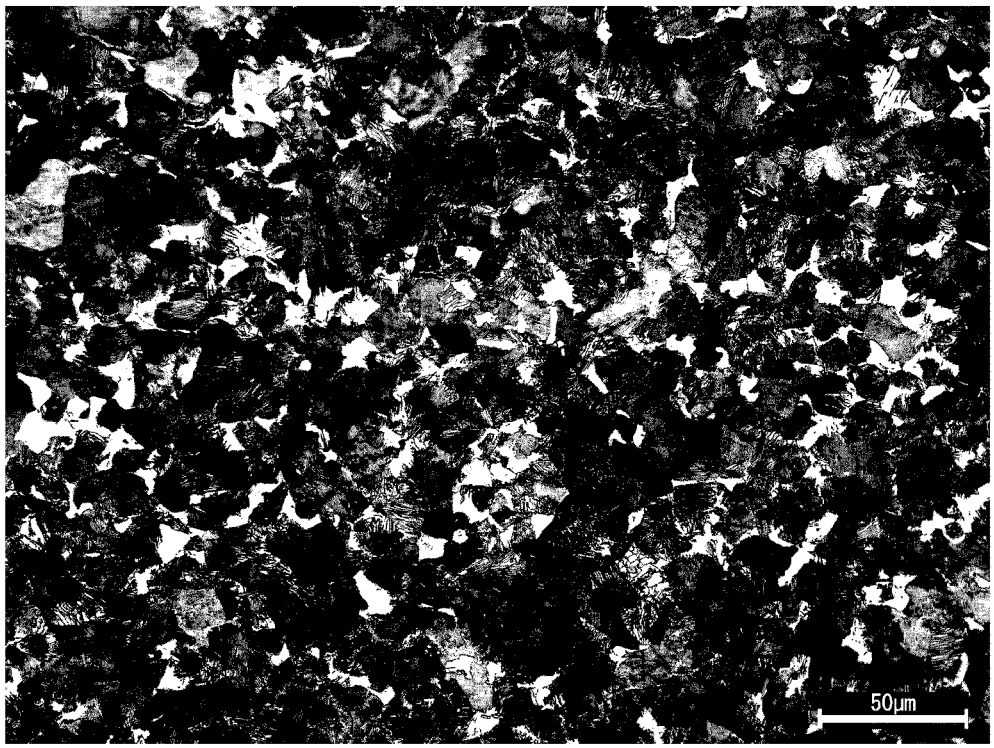
FIG. 2A is a structure photograph (magnification of 400) showing an example of the structure of a conventional rolled wire rod for spring steel.
Figure 2B:
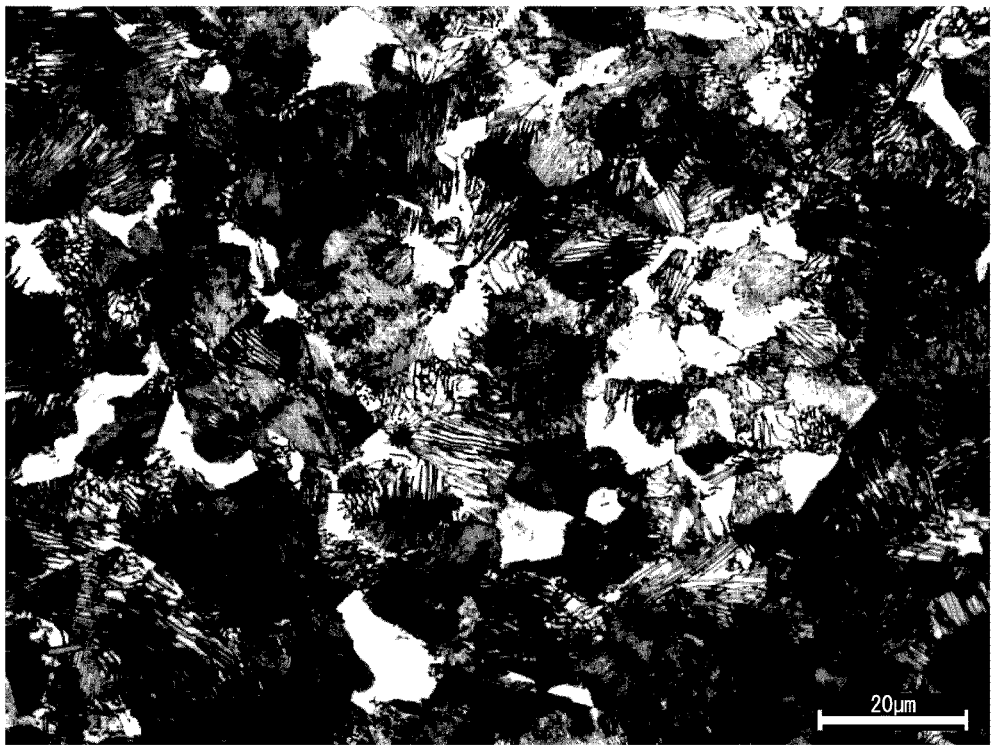
FIG. 2B is a structure photograph (magnification of 1,000) showing an example of the structure of the conventional rolled wire rod for spring steel.

FIGS. 1A and 1B are an example of the structure of the rolled wire rod for spring steel according to this embodiment, and show a structure composed of bainite and tempered martensite. FIGS. 2A and 2B are an example of the structure of a conventional rolled wire rod for spring steel, and show a structure composed of ferrite and pearlite.

In the measurement of a tensile strength, a tensile test is performed using a round-bar No. 2 test piece based on the tensile test method of "JIS Z 2241" to measure a maximum tensile strength until breaking. In addition, a reduction of area is measured from the diameter of a maximum area reduction portion after breaking.

Next, an example of a method of manufacturing a rolled wire rod for spring steel according to this embodiment will be described. As long as the rolled wire rod for spring steel according to this embodiment has the above-described configuration, it can obtain the effects thereof regardless of the manufacturing method. However, the rolled wire rod for spring steel is preferably manufactured by the following manufacturing method since the effects can be stably obtained.

For example, a steel ingot having the above-described chemical composition is heated at a temperature of 950"C or higher and 1,200° C. or lower for a time not longer than 120 minutes to form a rolled wire rod having a wire diameter of about 12 to 18 mm by hot rolling (hot rolling step). The rolled wire rod heated to red heat is processed to have a ring form suitable for winding, and then put into a water tank (cooling step).

The rolling completion temperature in the hot rolling step is set to 900° C. to 1,000° C., and the time from the completion of the rolling to the putting into the water tank is set to 30 seconds or shorter.

In the cooling step, the rolled wire rod put into the water tank is cooled to 200° C. or lower. After the rolled wire rod is cooled to 200° C. or lower, the rolled wire rod is pulled out of the water tank so as to be cooled at an average cooling rate of 5 to 30° C. is. The heating temperature of steel, the rolling completion temperature of steel, and the temperature of steel during cooling are set as a surface temperature of steel. The average cooling rate is an average cooling rate in which a difference between a temperature of steel at the time of starting the cooling and a cooling completion temperature is a numerator, and a difference between a cooling start time and a cooling completion time is a denominator. The cooling is started when the rolled wire rod is put into the water tank, and completed when the rolled wire rod is pulled out of the water tank.

The microstructure is turned into a structure including bainite and martensite as a primary phase by the hot rolling step and the subsequent cooling step. In a case where the rolling completion temperature is lower than 900° C. or higher than 1,000° C., or the average cooling rate during, cooling is less than 5° C./s, ferrite and pearlite are likely to precipitate, and the area fraction of bainite and martensite is thus reduced. The average cooling rate is preferably 10° C./s or greater. The higher the average cooling rate is, the better it is. However, in a case where the average cooling rate is greater than 30° C./s, the effects thereof are saturated, and thus the upper limit of the average cooling rate is set to 30° C./s or less.

For setting a tensile strength to be 1,350 MPa or less, that is a strength at which wire drawing is possible, the coiled material of the rolled wire rod after the cooling is softened and annealed at 300° C. to 500° C. for 2 to 24 hours. By softening annealing, the martensite turns into tempered martensite. Under the above annealing conditions, a tensile strength of 1,350 MPa or less and a reduction of area of 40% or less can be achieved.

Through the above manufacturing method, a rolled wire rod for spring steel according to this embodiment is manufactured. In order to obtain a spring steel from the above-described rolled wire rod for spring steel, the rolled wire rod for spring steel is subjected to wire drawing, and then quenched and tempered. The quenching may be performed by induction heating and quenching. Regarding conditions of the quenching and tempering, the quenching and tempering may be performed under such conditions that the tensile strength of the spring steel is 2,000 MPa or greater. According to the rolled wire rod for spring steel according to this embodiment, it is possible to obtain a spring steel having high toughness, e.g. a Charpy impact value of 60.0 J/cm$^2$ or greater at 23±5° C. even in a case where the tensile strength is 2,000 MPa or greater due to quenching and tempering.

EXAMPLES

Next, examples of the invention will be described. The conditions in the examples are one condition example employed to confirm the practicability and effects of the invention, and the invention is not limited to the one condition example. The invention can employ various conditions as long as the object of the invention is achieved without departing from the gist of the invention.

Tables 1 and 2 show components of examples and comparative examples. In Tables 1 and 2, the symbol "-" represents that the element related to the above symbol is not positively contained. In Tables 1 and 2, the remainder includes Fe and impurities.

TABLE 1

(mass %)

| | | C | Si | Mn | P | S | Cr | Mo | V | Cu | Ni | Al | Ti | Nb | N | B | Ceq |
|---|---|---|---|---|---|---|---|---|---|---|---|---|---|---|---|---|---|
| Examples | 1 | 0.50 | 1.50 | 0.70 | 0.007 | 0.008 | 0.70 | | | | | 0.020 | 0.070 | | 0.0032 | 0.0025 | 0.82 |
| | 2 | 0.50 | 2.00 | 0.50 | 0.005 | 0.009 | 0.80 | | | 0.20 | 0.25 | 0.025 | 0.070 | | 0.0040 | 0.0030 | 0.83 |
| | 3 | 0.50 | 2.00 | 0.70 | 0.012 | 0.012 | 0.20 | | 0.20 | | 0.60 | 0.018 | | | 0.0052 | 0.0025 | 0.77 |
| | 4 | 0.52 | 1.70 | 0.32 | 0.006 | 0.005 | 0.45 | 0.35 | | 0.12 | 0.10 | 0.022 | 0.025 | | 0.0030 | 0.0035 | 0.82 |
| | 5 | 0.52 | 2.30 | 0.30 | 0.006 | 0.005 | 0.90 | 0.30 | 0.20 | 0.25 | 0.45 | 0.022 | 0.056 | | 0.0030 | 0.0035 | 0.95 |
| | 6 | 0.55 | 1.45 | 0.70 | 0.008 | 0.006 | 0.69 | | | | | 0.021 | | | 0.0036 | 0.0021 | 0.87 |
| | 7 | 0.47 | 1.80 | 0.71 | 0.007 | 0.006 | 0.70 | | | | | 0.031 | | | 0.0042 | 0.0025 | 0.80 |
| | 8 | 0.58 | 1.51 | 0.68 | 0.008 | 0.005 | 0.70 | | | | | | | | 0.0045 | 0.0022 | 0.90 |
| | 9 | 0.55 | 1.15 | 0.70 | 0.009 | 0.008 | 0.70 | 0.22 | | | | 0.024 | | 0.005 | 0.0039 | 0.0032 | 0.91 |
| | 10 | 0.50 | 2.60 | 0.69 | 0.008 | 0.006 | 0.70 | | | | | | | | 0.0055 | 0.0025 | 0.86 |
| | 11 | 0.51 | 1.70 | 0.25 | 0.009 | 0.007 | 0.65 | 0.25 | | | | 0.026 | | | 0.0045 | 0.0028 | 0.82 |
| | 12 | 0.53 | 1.49 | 1.10 | 0.007 | 0.008 | 0.51 | | 0.20 | | | | | | 0.0052 | 0.0031 | 0.89 |
| | 13 | 0.55 | 1.69 | 0.60 | 0.008 | 0.006 | 0.29 | 0.21 | 0.12 | | | | | | 0.0050 | 0.0025 | 0.84 |
| | 14 | 0.48 | 1.20 | 0.55 | 0.007 | 0.005 | 1.45 | | | | | 0.030 | | | 0.0033 | 0.0022 | 0.91 |
| | 15 | 0.52 | 1.50 | 0.48 | 0.008 | 0.008 | 0.71 | 0.55 | | | | | 0.035 | | 0.0048 | 0.0024 | 0.94 |
| | 16 | 0.49 | 1.49 | 0.51 | 0.006 | 0.002 | 0.70 | | 0.48 | | | | | | 0.0042 | 0.0027 | 0.81 |
| | 17 | 0.55 | 1.50 | 0.68 | 0.008 | 0.007 | 0.70 | | | 0.35 | 0.40 | 0.026 | | | 0.0038 | 0.0024 | 0.88 |
| | 18 | 0.55 | 1.70 | 0.69 | 0.010 | 0.005 | 0.72 | | | | 0.52 | 0.031 | | 0.006 | 0.0045 | 0.0022 | 0.89 |
| | 19 | 0.54 | 1.99 | 0.50 | 0.008 | 0.006 | 0.69 | | | 0.13 | 0.16 | 0.022 | 0.032 | | 0.0041 | 0.0016 | 0.85 |
| | 20 | 0.56 | 1.52 | 0.69 | 0.007 | 0.006 | 0.70 | | | | | 0.050 | 0.005 | | 0.0052 | 0.0045 | 0.88 |

A blank indicates that the corresponding element is not positively contained.

The remainder consists of iron and impurities.

Ceq = [C %] + [Si %]/24 + [Mn %]/6 + [Cr %]/5 + [Mo %]/4 + [V %]/14 + [Ni %]/40

TABLE 2

(mass %)

| | | C | Si | Mn | P | S | Cr | Mo | V | Cu | Ni | Al | Ti | Nb | N | B | Ceq |
|---|---|---|---|---|---|---|---|---|---|---|---|---|---|---|---|---|---|
| Comparative Examples | 21 | 0.45 | 1.60 | 0.50 | 0.007 | 0.008 | 0.50 | | | | | 0.020 | | | 0.0032 | 0.0025 | 0.70 |
| | 22 | 0.52 | 1.50 | 0.70 | 0.005 | 0.009 | 0.20 | | | | | 0.025 | 0.020 | | 0.0040 | 0.0030 | 0.74 |
| | 23 | 0.55 | 2.00 | 1.20 | 0.012 | 0.012 | 0.90 | | 0.20 | | 0.60 | 0.018 | | | 0.0052 | 0.0025 | 1.04 |
| | 24 | 0.55 | 2.10 | 0.68 | 0.011 | 0.010 | 1.10 | | 0.48 | | | 0.025 | | | 0.0052 | 0.0025 | 1.01 |
| | 25 | 0.62 | 1.50 | 0.68 | 0.009 | 0.006 | 0.70 | | | | | | | | 0.0040 | 0.0027 | 0.94 |
| | 26 | 0.35 | 1.70 | 1.10 | 0.008 | 0.006 | 0.71 | 0.25 | | | | 0.022 | | | 0.0042 | 0.0030 | 0.81 |
| | 27 | 0.55 | 0.41 | 0.69 | 0.007 | 0.007 | 0.70 | | | | | | | | 0.0050 | 0.0028 | 0.82 |
| | 28 | 0.55 | 3.50 | 0.70 | 0.008 | 0.006 | 0.68 | | | | | 0.027 | | | 0.0048 | 0.0032 | 0.95 |
| | 29 | 0.51 | 1.21 | 1.81 | 0.010 | 0.008 | 0.50 | | | | | | | | 0.0046 | 0.0024 | 0.96 |
| | 30 | 0.50 | 1.20 | 0.19 | 0.009 | 0.006 | 1.94 | | | | | | | | 0.0047 | 0.0029 | 0.97 |
| | 31 | 0.50 | 2.00 | 0.70 | 0.012 | 0.012 | 0.20 | | 0.20 | | 0.60 | 0.018 | | | 0.0052 | 0.0025 | 0.77 |
| | 32 | 0.52 | 1.70 | 0.32 | 0.006 | 0.005 | 0.45 | 0.35 | | 0.12 | 0.10 | 0.022 | 0.025 | | 0.0030 | 0.0035 | 0.82 |

An underline indicates that the underlined value is out of the range of the invention.
A blank indicates that the corresponding element is not positively contained.
The remainder consists of iron and impurities.
Ceq = [C %] + [Si %]/24 + [Mn %]/6 + [Cr %]/5 + [Mo %]/4 + [V %]/14 + [Ni %]/40

Steel ingots having the components shown in Tables 1 and 2 were heated at a temperature of 950° C. or higher and 1,200° C. or lower for a time not longer than 120 minutes, and hot-rolled into wire rods of 12 to 18 mm in ϕ (diameter). After final hot rolling, the red-hot rolled wire rod was processed to have a ring form suitable for winding, and then conveyed by a belt conveyor and put into a water tank. In this case, the rolling completion temperature was set to 900° C. to 1,000° C., and the time from the completion of the rolling to the putting into the water tank was set to 30 seconds or shorter. The rolled wire rod put into the water tank was cooled such that the average cooling rate until the rolled wire rod was pulled out of the water tank was 10° C./s.

For setting a tensile strength to be 1,250 to 1,350 MPa, that is a strength at which wire drawing is possible, the coiled material of the rolled wire rod obtained was softened and annealed at an annealing temperature of 300° C. to 500° C. for an annealing time of 4 hours. To determine the annealing conditions, for example, strength measurement was performed after tempering at 300° C., 400° C., and 500° C. as a preliminary test, and a tempering temperature at which a predetermined strength was achieved was estimated. In this manner, rolled wire rods for spring steel were manufactured.

The obtained rolled wire rod for spring steel was subjected to induction quenching and tempering, and thus a heat-treated wire was obtained. The heat-treated wire corresponds to a spring steel made of a rolled wire rod for spring steel. The induction quenching was performed under conditions of a heating temperature of 920° C. to 1,040° C. and a heating time of 12 seconds. The tempering conditions were adjusted within a range of 360° C. to 540° C. and a range of 20 to 24 seconds to achieve a tensile strength of 2,000 MPa or greater.

<Tensile Test>

From the rolled wire rod for spring steel after the softening annealing, a tensile test piece was collected such that a longitudinal direction of the test piece was a rolling direction of the wire rod, and a tensile test was performed. The tensile test was performed using a round-bar No. 2 test piece based on "JIS Z 2241". The maximum tensile strength until breaking was measured, and the reduction of area was measured from the diameter of a maximum area reduction portion after breaking. In this manner, the tensile strength and the reduction of area of the rolled wire rod for spring steel were measured.

In addition, a tensile test piece was collected from the heat-treated wire such that a longitudinal direction of the test piece was a rolling direction of the wire rod, and a tensile test was performed using a round-bar No. 2 test piece based on "JIS Z 2241". The tensile strength of the heat-treated wire was obtained by measuring the maximum tensile strength until breaking.

<Observation of Microstructure>

A structure observation test piece was collected from the rolled wire rod for spring steel after the softening annealing, and a microstructure thereof was observed. The rolled wire rod for spring steel after the softening annealing was cut at a central longitudinal cross section, etched with 3% vital (3% nitric acid-ethanol solution) after forming and polishing, and observed with an optical microscope for metallic microstrucuture. A position of ¼ of the diameter inside from the surface of the rolled wire rod in the longitudinal cross section was set as an observation position, and 5-visual field observation was performed with an optical microscope for metallic microstructure with magnification of 400. The observed microstructures were classified and determined as "bainite and tempered martensite", "ferrite", and "pearlite", and the area fraction of "bainite and tempered martensite" was obtained. Since it was difficult to distinguish the bainite after the softening annealing from the tempered martensite, both were handled together.

<Charpy Impact Test>

Based on "HS Z 2242", a 2 mm U-notched Charpy test piece with a thickness of 5 mm subsize was collected such that a longitudinal direction of the test piece from the center of the heat-treated wire was a rolling direction of the wire rod. A Charpy impact test was performed based on "JIS Z 2242" to obtain a Charpy impact value (J/cm$^2$). The measurement temperature was set within a range of 23±5° C.

TABLE 3

| | | Rolled Wire Rod | | | | Heat-Treated Wire | |
|---|---|---|---|---|---|---|---|
| | | Average Cooling Rate ° C./s | Tensile Strength MPa | Reduction of Area % | B + M area % | Tensile Strength MPa | Impact Value J/cm$^2$ |
| Examples | 1 | 10 | 1189 | 48.5 | 96 | 2024 | 62.1 |
| | 2 | 10 | 1222 | 50.2 | 100 | 2050 | 70.3 |
| | 3 | 10 | 1215 | 47.9 | 94 | 2048 | 73.5 |

TABLE 3-continued

| | Rolled Wire Rod | | | | Heat-Treated Wire | |
|---|---|---|---|---|---|---|
| | Average Cooling Rate ° C./s | Tensile Strength MPa | Reduction of Area % | B + M area % | Tensile Strength MPa | Impact Value J/cm$^2$ |
| 4 | 10 | 1253 | 45.8 | 100 | 2097 | 65.8 |
| 5 | 10 | 1215 | 47.9 | 100 | 2117 | 73.5 |
| 6 | 10 | 1268 | 50.7 | 95 | 2025 | 74.5 |
| 7 | 10 | 1160 | 52.2 | 94 | 2074 | 80.7 |
| 8 | 10 | 1317 | 42.3 | 100 | 2039 | 73.6 |
| 9 | 10 | 1245 | 43.7 | 96 | 2038 | 73.8 |
| 10 | 10 | 1307 | 48.6 | 98 | 2069 | 78.4 |
| 11 | 10 | 1250 | 42.8 | 97 | 2088 | 74.7 |
| 12 | 10 | 1273 | 47.7 | 100 | 2064 | 75.8 |
| 13 | 10 | 1205 | 53.6 | 95 | 2080 | 73.1 |
| 14 | 10 | 1266 | 48.6 | 100 | 2058 | 79.2 |
| 15 | 10 | 1297 | 46.7 | 100 | 2055 | 81.1 |
| 16 | 10 | 1310 | 44.2 | 95 | 2068 | 72.5 |
| 17 | 10 | 1248 | 52.1 | 100 | 2056 | 82.4 |
| 18 | 10 | 1263 | 50.3 | 100 | 2077 | 84.3 |
| 19 | 10 | 1184 | 48.5 | 96 | 2105 | 68.9 |
| 20 | 10 | 1244 | 51.1 | 100 | 2045 | 72.5 |

B + M indicates a total of bainite and tempered martensite.

TABLE 4

| | | Rolled Wire Rod | | | | Heat-Treated Wire | |
|---|---|---|---|---|---|---|---|
| | | Average Cooling Rate ° C./s | Tensile Strength MPa | Reduction of Area % | B + M area % | Tensile Strength MPa | Impact Value J/cm$^2$ |
| Comparative Examples | 21 | 10 | 1258 | 22.4 | 68 | 2031 | 57.8 |
| | 22 | 10 | 1264 | 32.9 | 82 | 2045 | 52.3 |
| | 23 | 10 | | | Cracks | | |
| | 24 | 10 | 1231 | 42.7 | 100 | 2015 | 42.8 |
| | 25 | 10 | 1228 | 36.9 | 100 | 2048 | 50.7 |
| | 26 | 10 | 1248 | 42.5 | 96 | 1894 | 72.6 |
| | 27 | 10 | 1267 | 44.5 | 94 | 2051 | 28.9 |
| | 28 | 10 | 1435 | 38.7 | 92 | 2038 | 49.8 |
| | 29 | 10 | 1314 | 36.7 | 100 | 2043 | 50.4 |
| | 30 | 10 | 1298 | 31.8 | 100 | 2054 | 51.6 |
| | 31 | 2 | 1186 | 31.4 | 25 | 2043 | 52.9 |
| | 32 | 2 | 1275 | 33.5 | 46 | 2038 | 49.1 |

B + M indicates a total of bainite and tempered martensite.

An underline indicates that the underlined value is out of the range of the invention or is not a suitable characteristic value.

The results are shown in Tables 3 and 4. In a case where the heat-treated material had a tensile strength of 2,000 MPa or greater and a Charpy impact value of 60.0 J/cm$^2$ or greater, it was judged that preferable properties were obtained.

In any of Examples 1 to 20 of the invention, the reduction of area exceeded 40% in a case where the tensile strength was adjusted to 1,150 to 1,350 MPa, and it can be determined that sufficient drawability is secured. In all of the examples, bainite and tempered martensite accounted for 90% or greater of the microstructure by area fraction.

In a case where the rolled wire rod of the example was subjected to induction quenching and tempering, a heat-treated wire having a tensile strength of 2,000 MPa or greater and a Charpy impact value of 60.0 J/cm$^2$ or greater was obtained, and thus both a high strength and high toughness were achieved.

In Comparative Examples 21 and 22, the carbon equivalent was less than 0.75%, the amounts of alloying elements were too small, and hardenability was not sufficient. In the structure subjected to in-line quenching after hot rolling, ferrite or pearlite was mixed with bainite and martensite, and the reduction of area of the rolled wire rod for spring steel was reduced. Moreover, the Charpy impact value of the heat-treated wire was less than 60.0 J/cm$^2$, and toughness was not sufficient.

In Comparative Example 23, the carbon equivalent exceeded 1.00%, and quenching cracks were generated in the rolled wire rod for spring steel, whereby it was not possible to perform the evaluation.

In Comparative Example 24, the microstructure of the rolled wire rod for spring steel was composed of bainite and tempered marten site. However, since the carbon equivalent exceeded 1.00%, undissolved carbides remained after induction heating quenching and tempering, and the Charpy impact value of the heat-treated wire was low.

In Comparative Examples 25, 29, and 30, the C content, the Mn content, and the Cr content were excessive, respectively, and the reduction of area of the rolled wire rod for spring steel was low. In addition, the Charpy impact value of the heat-treated wire subjected to induction quenching and tempering was also low.

In Comparative Example 26, the C content was not sufficient. As a result, even in a case where the induction quenching and tempering conditions were appropriately changed, it was not possible to increase the tensile strength of the heat-treated wire to 2,000 MPa or greater.

In Comparative Example 27, the Si content was not sufficient. As a result, there was a tendency that the tensile strength after induction heating quenching and tempering decreased. Therefore, in a case where the tempering conditions were adjusted such that the tensile strength of the heat-treated wire was 2,000 MPa or greater, it was necessary to excessively reduce the tempering temperature, and it was not possible to obtain a sufficient Charpy impact value. That is, in the rolled wire rod for spring steel of Comparative Example 27, it was difficult to obtain a heat-treated wire excellent in both the tensile strength and the toughness.

In Comparative Example 28, the Si content was excessive. Therefore, even in a case where the rolled wire rod after cooling was softened and annealed within a predetermined temperature range, the tensile strength did not decrease, and thus the tensile strength was too high, and the reduction of area was reduced. In addition, since the Si content was excessive, the Charpy impact value of the heat-treated wire subjected to quenching and tempering was also low.

In Comparative Examples 31 and 32, although the components of steel were within the ranges of the invention, the average cooling rate after rolling was low. Therefore, pearlite and ferrite were mixed, and the area fraction of the bainite and martensitic structure was not sufficient. As a result, the reduction of area of the rolled wire rod was not sufficient. In addition, since the heat-treated wire had a non-uniform structure, it was not possible to obtain a sufficient Charpy impact value.

INDUSTRIAL APPLICABILITY

A rolled wire rod for spring steel according to the invention is directly quenched after wire rolling to include bainite and martensite, and is softened and annealed to achieve a strength at which wire drawing is possible, such that carbides are easily solid-solubilized during induction quenching and tempering, and both a high tensile strength and a high Charpy impact value can be achieved. Therefore, according to the invention, it is possible to obtain a rolled wire rod for spring steel capable of securing an impact value while having a high strength of 2,000 MPa or greater by an induction heat treatment. Accordingly, the invention has high industrial applicability.

What is claimed is:

1. A rolled wire rod for spring steel before drawing, quenching and tempering, comprising, as a chemical composition, by mass %:

C: 0.42% to 0.60%;
Si: 0.90% to 3.00%;
Mn: 0.10% to 1.50%;
Cr: 0.10% to 1.50%;
B: 0.0010% to 0.0060%;
N: 0.0010% to 0.0070%;
Mo: 0% to 1.00%;
V: 0% to 1.00%;
Ni: 0% to 1.00%;
Cu: 0% to 0.50%;
Al: 0% to 0.100%;
Ti: 0% to 0.100%;
Nb: 0% to 0.100%;
P: limited to less than 0.020%;
S: limited to less than 0.020%; and
a remainder including Fe and impurities,
wherein a carbon equivalent (Ceq) specified by Formula (1) is 0.75% to 1.00%, wherein Formula (1) is defined as:

$$Ceq=[C\ \%]+[Si\ \%]/24+[Mn\ \%]/6+[Cr\ \%]/5+[Mo\ \%]/4+[V\ \%]/4+[Ni\ \%]/40;$$

an area fraction of tempered martensite and bainite included in a microstructure is 90% or greater, and
a tensile strength is 1,350 MPa or less, and a reduction of area, which is measured based on "JIS Z 2241", is 40% or greater.

2. The rolled wire rod for spring steel before drawing, quenching and tempering according to claim 1, comprising, by mass %:

one or more of Mo: 0.10% to 1.00%, V: 0.05% to 1.00%, Ni: 0.05% to 1.00%, Cu: 0.05% to 0.50%, Al: 0.005% to 0.100%, Ti: 0.005% to 0.100%, and Nb: 0.005% to 0.100%.

* * * * *